US005335370A

United States Patent [19]

Bassick et al.

[11] Patent Number: 5,335,370

[45] Date of Patent: Aug. 9, 1994

[54] PARTIAL PRESSURE CUFF SEAL FOR UTILIZATION IN A FULL PRESSURE SUIT

[75] Inventors: John W. Bassick, Paxton; Edward A. Dubois, Auburn, both of Mass.

[73] Assignee: David Clark Company Inc., Worcester, Mass.

[21] Appl. No.: 35,687

[22] Filed: Mar. 23, 1993

[51] Int. Cl.[5] ..... A62B 17/00

[52] U.S. Cl. ..... 2/214; 2/2.11

[58] Field of Search ..... 2/2.11, 2.12, 2.13, 2/2.14; 285/95, 100, 109; 277/34, 34.3, 34.6, 212 FB, 212 C

[56] References Cited

U.S. PATENT DOCUMENTS 2,762,047 9/1956 Flagg et al. .

OTHER PUBLICATIONS

NASA Final Report, Apr. 1990, "*Eva Gloves*: History, Status, and Recommendations for Future NASA Research", Lyndon B. Johnson Space Center, Houston, Tex. JSC-23733, pp. x-xii, 28-34.

*Primary Examiner*—Clifford D. Crowder

*Assistant Examiner*—Gloria Hale

*Attorney, Agent, or Firm*—Samuels, Gauthier & Stevens

[57] ABSTRACT

A cuff seal utilized in a portion of a full pressure suit which envelopes a limb of a wearers body, the full pressure suit defining at least one full pressure compartment. The cuff seal includes a gas impermeable outer sheath configured to envelope a portion of the limb, the sheath having a first end in pressurized communication with the full pressure compartment, and a second end having an opening through which a portion of said limb exteriorly protrudes from the interior of the full pressure compartment. A gas impermeable inner sleeve is provided having an outer end, an intermediate section and an inner end disposed within the sheath, the outer end of the sleeve being joined in a sealed relationship to the interior of the sheath proximate to the second end, and the intermediate section of the sleeve being adapted to surround and coact in a sealed relationship with a portion of the limb. The sleeve is therefor adapted to interiorly seal the full pressure compartment from the opening to the exterior of the suit when donned by the wearer.

18 Claims, 2 Drawing Sheets

PARTIAL PRESSURE CUFF SEAL FOR UTILIZATION IN A FULL PRESSURE SUIT

BACKGROUND OF THE INVENTION

The invention relates to a partial pressure cuff seal for utilization in a full pressure suit.

Conventional pilot protective equipment provides primarily either high altitude protection or low altitude/high acceleration protection. Typically, the equipment used for these situations are full and partial pressure suits which provide pressure protection above 62,000 feet altitude for an extended period of time, and anti-G suits used in conjunction with unpressurized helmets, oxygen masks and torso counter-pressure garments which provide limited altitude protection (<62,000 feet) and limited acceleration protection (<3+Gz). The low altitude/high acceleration equipment configuration is currently utilized in fighter aircraft applications.

The conventional protective equipment for fighter pilots has remained essentially the same since the introduction of jet fighter aircraft. This equipment consists of a separate helmet, oxygen mask, anti-G suit, a coverall, and, more recently, torso counter-pressure garments, as required. With the recent advent of high performance fighter aircraft capable of sustained high acceleration (9+Gz) and high altitude (+50,000 feet) flight air crew protection has become the major limitation in aircraft operation. This is due to both current standard equipment design limitations and lack of integration by design.

One major limitation to fighter air crew performance is the conventional full pressure gloves utilized with full pressure suits. While these gloves are safe and reliable, they typically lack the flexibility and tactility desired for many pilot operations. A more detailed discussion relating to full pressure glove drawbacks and the need for future development with particular attention to astronaut extra-vehicular activity (EVA) is found in "EVA Gloves: History, Status, and Recommendations for Future NASA Research", Final Report April 1990, NASA JSC-23733, pages x–xii and 28–34.

Partial pressure gloves provide better hand tactility and mobility for the wearer's hand than full pressure gloves, since they are designed to be conformal and snug fitting. Also, partial pressure gloves are cooler since the hands are exposed to ambient air. As opposed to the full pressure glove which comprises a compartment that envelops and applies air pressure to the hand, the partial pressure glove has a separate bladder-like compartment which is pressurized in order to tighten the glove and apply direct mechanical pressure to the hand. Unfortunately, heretofore it has been impractical to integrate partial pressure gloves with full pressure suits due to the fundamental differences in principles of operation between full and partial pressure garments and the lack of adequate sealing devices or techniques at the cuff areas of the sleeves of the full pressure suits for coupling with partial pressure gloves.

SUMMARY OF THE INVENTION

Accordingly, it is an object of the present invention to provide a seal for use at the cuff areas or other openings through which body parts of a wearer extend from within a full pressure suit for effectively sealing the inner pressure compartment.

The present invention is directed to a cuff seal utilized in a portion of a full pressure suit which envelopes a limb of a wearers body, the full pressure suit defining at least one full pressure compartment. The cuff seal comprises a gas impermeable outer sheath configured to envelope a portion of the limb, the sheath including a first end in pressurized communication with the full pressure compartment, and a second end having an opening through which a portion of said limb exteriorly protrudes from the interior of the full pressure compartment. A gas impermeable inner sleeve is provided having an outer end, an intermediate section and an inner end disposed within the sheath, the outer end of the sleeve being joined in a sealed relationship to the interior of the sheath proximate to the second end, and the intermediate section of the sleeve being adapted to surround and coact in a sealed relationship with a portion of the limb. The sleeve is therefor adapted to interiorly seal the full pressure compartment from the opening the exterior of the suit when donned by the wearer.

DETAILED DESCRIPTION OF THE ILLUSTRATED EMBODIMENTS

Figure 1:
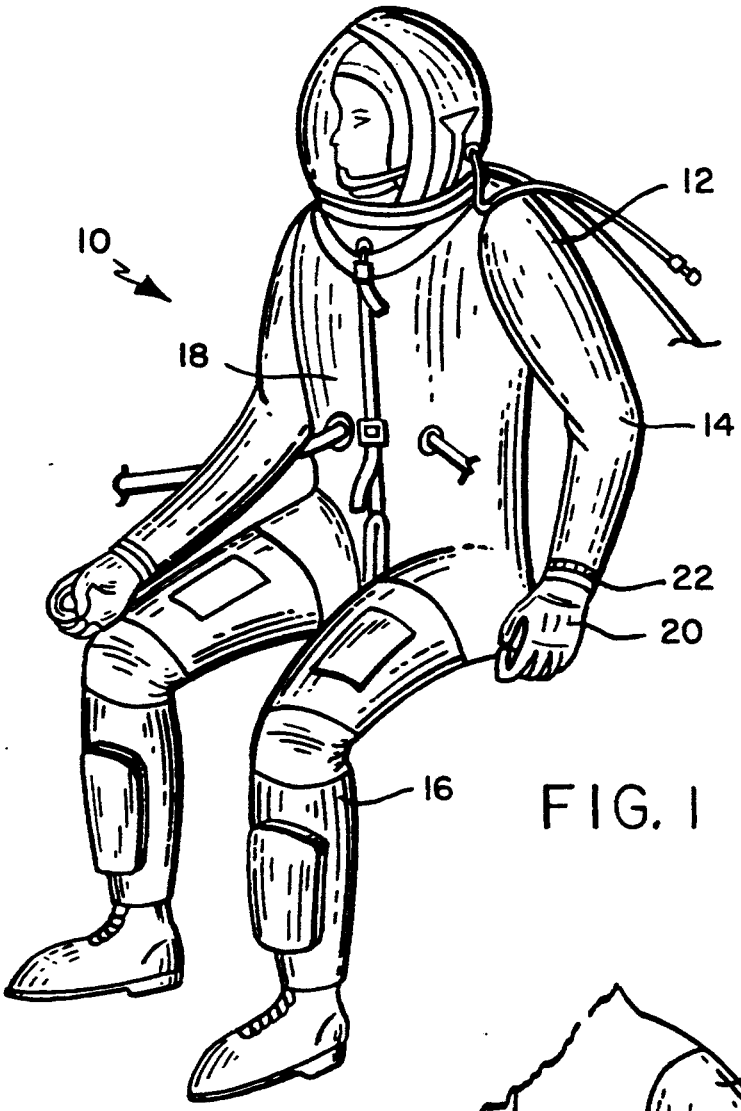
FIG. 1 shows a perspective view of a conventional full pressure suit utilizing a full pressure glove configuration.

With reference now to FIG. 1, a full pressure coverall suit 10 is shown. The suit 10, for example, may be a multiple compartment full pressure coverall suit as described in copending U.S. patent application Ser. No. 07/929,257 filed Aug. 13, 1992 for "Dual Compartment Pressure Suit" of common assignee. The suit 10 includes a loose-fitting outer garment or sheath 12 for the reception and enclosure of either or both of the upper and lower body portions of a wearer. The sheath is preferably constructed from a flexible and gas impermeable material. An exemplary material from which the sheath 12 may be made is described in U.S. Pat. No. 5,003,630 issued to Bassick et al. and of common assignee, incorporated herein by reference, which discloses a breathable material for a pressure garment utilizing a combination of hydrophilic and hydrophobic layers. Such material serves to retain gas pressures within the full pressure suit and to minimize thermal loading.

The sheath 12 as shown includes both arm-receiving portions 14 and leg-receiving portions 16, which are configured as tubular extensions of the sheaths trunk-encircling portion 18. The outer sheath 12 defines one or more full pressure compartments in which the wearers body is enclosed.

Provided with the full pressure suit 10 of FIG. 1, are full pressure gloves 20 which are connected to the coverall sleeves 14 via quick disconnects 22 having integral low torque sealed bearings for maximum mobility in both unpressurized and pressurized modes. The gloves 20 are preferably patterned and designed to maximize comfort, tactility and mobility in both pressure modes. This is accomplished by integrating a combination of both breathable and non-breathable glove bladder materials with high temperature outer glove materials having good comfort, tactile and wear properties. The full pressure gloves are generally adapted to serve as a continuation of the full pressure chamber defined within the outer sheath 12 and extending within the sleeve portion 14. Therefore, the hand of the wearer will typically be enclosed within the glove such that the same air pressure is applied directly to both the hands and arms enclosed within sleeve 14.

Figure 2:
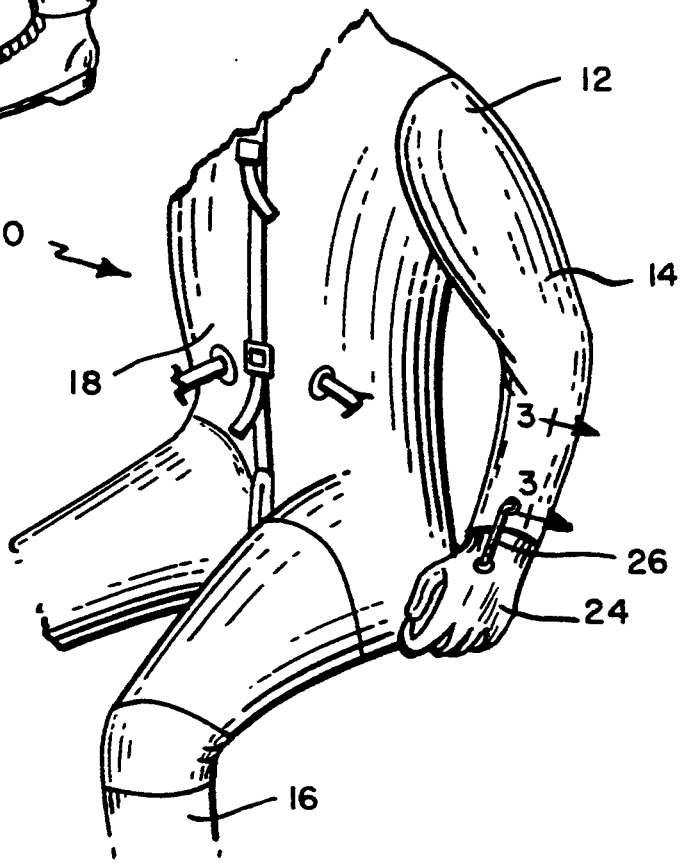
FIG. 2 shows a perspective view of a conventional full pressure suit utilizing a partial pressure glove configuration in accordance with the present invention.

FIG. 2 shows a full pressure suit 10 which is configured to be utilized with a partial pressure glove 24 coupled to the end of the sleeve portion 14. In this configuration, the partial pressure glove does not serve as a continuation of the pressure compartment within the sleeve 14. Instead, the glove 24 includes a separate pressure compartment which is in pressurized communication with the full pressure compartment of the suit 10 via a sealed connector assembly 26 such as a bayonet connecting assembly. In order for the wearer of the suit 10 to utilize the partial pressure gloves, a seal is required proximate to the end or opening portion of the sleeve 14. For that matter, a similar seal is required near the opening of the leg portion 16 if the wearer chooses to wear partial pressure booties or footwear.

Figure 3:
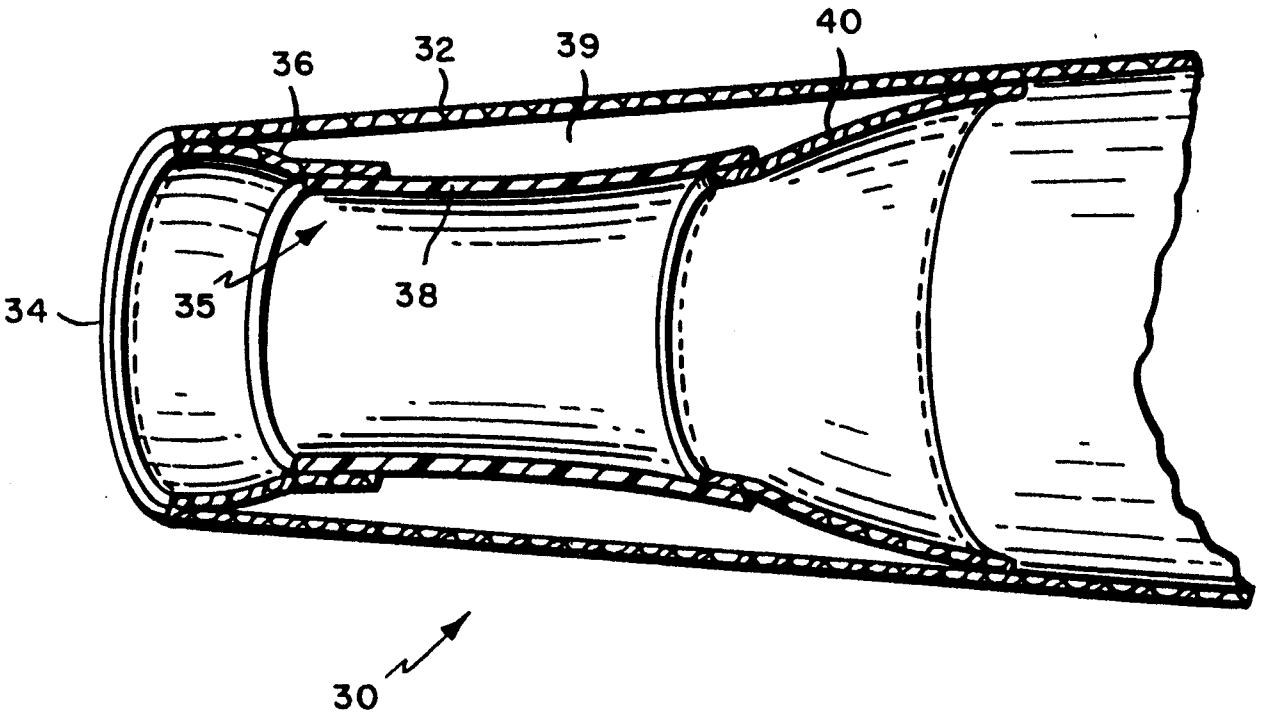
FIG. 3 shows an elevational sectional view taken along line 3—3 of FIG. 2 showing the partial pressure cuff seal in accordance with the present invention.

Accordingly, FIG. 3 shows a partial pressure cuff seal 30 in accordance with the present invention. The cuff seal 30 includes an outer sheath portion 32 of the full pressure suit proximate to an opening 34. The sheath portion 32 is configured to envelope a portion of a limb of the wearer, for instance an arm or leg. The limb of the wearer exteriorly protrudes from the interior of the full pressure compartment through the opening 34. The outer sheath 32 is preferably constructed from a gas impermeable material as described above in connection with the full pressure suit 10.

The cuff seal 30 further includes a gas impermeable inner sleeve 35 having an outer portion 36 which is joined in a sealed relationship to the interior of the outer sheath 32 proximate to the opening 34, and an intermediate section 38 which is adapted to surround and coact in a sealed relationship with the portion of the limb extending through the opening 34. The outer portion 36 is preferably configured from the same gas impermeable material used in the outer sheath 32. The intermediate portion 38 is constructed from a gas impermeable material such as the breathable material used in the outer sheath 32, neoprene or sheet rubber. Thus, the gas impermeable inner sleeve 35 extends into the pressure space 39 between the outer sheath 32 and the limb of the wearers body, so as to encircle a portion of the limb. The inner sleeve 35 preferably terminates within the pressure space 39 at a position favorably situated to its being urged by the pressure prevailing in the space 39 into close sealing contact with the portion of the limb that it surrounds.

In order to prevent the gas impermeable sleeve 35 from inverting when the limb of the wearer protrudes through the opening 34, a gas permeable sleeve 40 is joined between the inner end of the gas impermeable sleeve 35 and the interior of the outer sheath 32. In addition to preventing the gas impermeable sleeve 35 from inverting during donning or pressurization, the gas permeable sleeve 40 allows the space 39 to be pressurized with the remainder of the full pressure compartment of the suit 10. The sleeve 40 is preferably a loose-fitting single wall sleeve of suitable flexible gas permeable material.

Once the suit is pressurized or inflated, the pressurization has the effect of spacing the outer sheath 32 from the limb which it envelopes, as well as from the gas impermeable sleeve 35, and in turn the sleeve 35 is urged into close and intimate contact with the limb due to the build-up of pressure within the space 39. Such pressure within the space 39 is exerted against the intermediate portion 38, which is preferably initially snug fitting, causing the intermediate portion to be pressed against the limb, thereby sealing against any escape of pressure medium from the space 39 or the pressure compartment to the opening 34.

Accordingly, when the suit 10 is pressurized, portions of the limb enveloped by sheath 32 prior to the partial pressure cuff 30 are subjected directly to the pressure of the air within the pressure compartment, while that portion of the limb in contact with the gas impermeable sleeve 35 is subjected to this pressure indirectly.

In connection with the foregoing, it is apparent that the cuff seal in accordance with the present invention provides an improved sealing arrangement which is particularly adapted to enclose a selected portion of a wearers limb while for purposes of illustration the cuff seal has been shown as applied to the forearms of the wearer, it will be clear to those of skill in the art that the same principle of construction may be employed in connection with sealing other openings through which limbs of the wearer protrude from the interior pressure compartment of the full pressure suit.

What is claimed is:

1. A cuff seal in combination with a pressure suit which envelops a limb of a wearer's body, said pressure suit defining at least one pressure compartment, said cuff seal comprising:

a gas impermeable outer sheath configured to envelop a portion of said limb, said sheath including a first end in pressurized communication with said pressure compartment, and a second end having an opening through which said portion of said limb exteriorly protrudes from the interior of said pressure compartment; and a gas impermeable inner sleeve having an outer end, an intermediate section and an inner end which are disposed within said sheath, said outer end of said sleeve being joined in a sealed relationship to the interior of said sheath proximate to said second end, and said intermediate section of said sleeve being adapted to surround and coact in a sealed relationship with said portion of said limb, wherein said sleeve is adapted to interiorly seal said pressure compartment from said opening to the exterior of said pressure compartment when donned by said wearer.

2. The cuff seal of claim 1, wherein said inner end of said sleeve is coupled in a non-sealed relationship to the interior of said sheath proximate to said first end.

3. The cuff seal of claim 2, further comprising a gas permeable sleeve joined between said inner end of said gas impermeable sleeve and the interior of said sheath proximate to said first end.

4. The cuff seal of claim 3, wherein a partial pressure chamber in pressurized communication with said pressure compartment is defined between both said sleeves and the interior of said sheath.

5. The cuff seal of claim 1, wherein said gas impermeable sleeve extends inwardly within said sheath from said opening in spaced relation therewith and includes at said intermediate section an annular cuff portion for snug encirclement of said portion of said limb.

6. A cuff seal in combination with a pressure suit having a gas impermeable sheath configured to envelop a portion of a limb of a wearer's body, said sheath including a first end in pressurized communication with a pressure compartment defined by said suit and a second end having an opening through which said portion of said limb exteriorly protrudes from within said pressure compartment, said cuff seal comprising:

a gas impermeable inner sleeve having a first end joined in a sealed relationship to the interior of said sheath proximate to said opening, and extending inwardly within said sheath to a second end, said gas impermeable sleeve adapted to surround and coact in a sealed relationship with said portion of said limb; and a gas permeable sleeve having a first end joined to said second end of said gas impermeable sleeve and a second end joined in a non-sealed relationship to the interior of said sheath proximate to the said first end of said sheath.

7. The cuff seal of claim 6, wherein said gas impermeable sleeve comprises an annular cuff portion for snug encirclement of a portion of said limb.

8. The cuff seal of claim 7, wherein said annular cuff portion is adapted to interiorly seal said pressure compartment from sad opening to the exterior of said pressure compartment when donned by said wearer.

9. The cuff seal of claim 6, wherein said gas impermeable sleeve and gas permeable sleeve comprise intermediate sections which are configured to be in spaced relation with respect to said sheath.

10. The cuff seal of claim 9, wherein a partial pressure chamber in pressurized communication with said pressure compartment is defined between said sleeves and the interior of said sheath.

11. A cuff seal in combination with a pressure suit having a gas containing pressure compartment which envelops one portion of a limb of a wearer's body and from which another protruding portion of said limb extends beyond said compartment, said cuff seal comprising:

a gas impermeable outer sheath configured to envelop the protruding portion of said limb, said sheath including a first end in communication with said pressure compartment, and a second end having an opening through which the protruding portion of said limb extends beyond said sheath; and a gas impermeable inner sleeve within said sheath, said inner sleeve having an outer end, an intermediate section and an inner end, said outer end of said sleeve being joined in a sealed relationship to the interior of said sheath proximate to said second end, and said intermediate section of said sleeve being spaced inwardly from said sheath and adapted to surround and coact in a sealed relationship with the protruding portion of said limb to thereby prevent escape of gas from said pressure compartment when said pressure suit is donned by said wearer.

12. The cuff seal of claim 11, wherein said inner end of said sleeve is coupled in a non-sealed relationship to the interior of said sheath proximate to said first end.

13. The cuff seal of claim 12, further comprising a gas permeable sleeve joined between said inner end of said gas impermeable sleeve and the interior of said sheath proximate to said first end.

14. The cuff seal of claim 13, wherein a partial pressure chamber in pressurized communication with said pressure compartment is defined between both said sleeves and the interior of said sheath.

15. The cuff seal of claim 11, wherein said gas impermeable sleeve extends inwardly within said sheath from said opening in spaced relation therewith and includes at said intermediate section an annular cuff portion for snug encirclement of a portion of said limb.

16. The cuff seal of claim 11, wherein said pressure compartment is a full pressure compartment.

17. The cuff seal of claim 1, wherein said pressure compartment is a full pressure compartment.

18. The cuff seal of claim 6, wherein said pressure compartment is a full pressure compartment.

* * * * *